US011231155B2

(12) United States Patent
Wellens et al.

(10) Patent No.: US 11,231,155 B2
(45) **Date of Patent: *Jan. 25, 2022**

(54) METHOD FOR CONTROLLING THE LIGHT DISTRIBUTION OF A LUMINAIRE

(71) Applicant: SCHREDER, Brussels (BE)

(72) Inventors: Didier Wellens, Kraainem (BE); Helmut Schröder, Wiesbaden (DE); Daniel Brand, Cologne (DE); Jörg Richter, Nordhorn (DE)

(73) Assignee: SCHREDER, Brussels (BE)

( * ) Notice: Subject to any disclaimer, the term of this patent is extended or adjusted under 35 U.S.C. 154(b) by 0 days.

This patent is subject to a terminal disclaimer.

(21) Appl. No.: 16/983,128

(22) Filed: Aug. 3, 2020

(65) Prior Publication Data

US 2020/0365020 A1 Nov. 19, 2020

Related U.S. Application Data

(63) Continuation of application No. 16/505,376, filed on Jul. 8, 2019, now Pat. No. 10,733,882, which is a (Continued)

(30) Foreign Application Priority Data

Jan. 5, 2015 (EP) ..... 15150120

(51) Int. Cl.
*F21S 8/08* (2006.01)
*F21V 23/04* (2006.01)
(Continued)

(52) U.S. Cl.
CPC ..... *F21S 8/085* (2013.01); *F21V 5/007* (2013.01); *F21V 13/04* (2013.01); *F21V 14/02* (2013.01);
(Continued)

(58) Field of Classification Search
CPC ..... G08G 1/081; H05B 47/175; F21S 8/085; F21V 5/007
(Continued)

(56) References Cited

U.S. PATENT DOCUMENTS 9,894,736 B2 2/2018 Isaak
2012/0147604 A1 6/2012 Farmer
(Continued)

FOREIGN PATENT DOCUMENTS

CN 1509129 A 6/2004
CN 103162163 A 6/2013
(Continued)

OTHER PUBLICATIONS

International Search Report dated Apr. 22, 2016, issued in corresponding International Application No. PCT/EP2016/050076, filed Jan. 5, 2016, 3 pages.
(Continued)

*Primary Examiner* — Eric Blount
(74) *Attorney, Agent, or Firm* — Christensen O'Connor Johnson Kindness PLLC

(57) ABSTRACT

A method for controlling the light distribution of a traffic route luminaire in a network of luminaires, which is preferably also organized as a mesh network. The luminaire has a luminaire head having a settable light module and a controller while the light distribution of the luminaire is variable. The luminaire communicates luminaire data to at least one server, the luminaire data being luminaire-specific and related to the installation location of the luminaire. The data for a light distribution are automatically allocated to the luminaire and a setting of the light module is automatically effected on the basis of the data.

26 Claims, 7 Drawing Sheets

Related U.S. Application Data continuation of application No. 15/540,971, filed as application No. PCT/EP2016/050076 on Jan. 5, 2016, now Pat. No. 10,347,123.

(51) Int. Cl.

| | |
|---|---|
| ***H05B 45/10*** | (2020.01) |
| ***H05B 47/175*** | (2020.01) |
| ***F21V 5/00*** | (2018.01) |
| ***F21V 13/04*** | (2006.01) |
| ***F21V 14/02*** | (2006.01) |
| ***F21V 14/04*** | (2006.01) |
| ***F21V 14/06*** | (2006.01) |
| ***F21V 19/00*** | (2006.01) |
| ***G08G 1/081*** | (2006.01) |
| *F21W 111/02* | (2006.01) |
| *F21Y 115/10* | (2016.01) |
| *F21Y 115/15* | (2016.01) |

(52) U.S. Cl.

CPC ..... *F21V 14/04* (2013.01); *F21V 14/06* (2013.01); *F21V 19/0015* (2013.01); *F21V 23/0435* (2013.01); *G08G 1/081* (2013.01); *H05B 45/10* (2020.01); *H05B 47/175* (2020.01); *F21W 2111/02* (2013.01); *F21Y 2115/10* (2016.08); *F21Y 2115/15* (2016.08)

(58) Field of Classification Search

USPC ..... 340/909

See application file for complete search history.

(56) References Cited

U.S. PATENT DOCUMENTS

| | | | |
|---|---|---|---|
| 2013/0044487 | A1 | 2/2013 | Burrows et al. |
| 2013/0147389 | A1 | 6/2013 | Hoffer, Jr. et al. |
| 2013/0285556 | A1 | 10/2013 | Challapali et al. |
| 2014/0028216 | A1 | 1/2014 | Wang et al. |
| 2014/0056028 | A1 | 2/2014 | Nichol et al. |
| 2014/0265874 | A1 | 9/2014 | Marquardt et al. |
| 2015/0316233 | A1 | 11/2015 | Di Trapani et al. |

FOREIGN PATENT DOCUMENTS

| | | | |
|---|---|---|---|
| EP | 2779652 | A1 | 9/2014 |
| JP | 2004247273 | A | 9/2004 |
| JP | 2009289622 | A | 12/2009 |
| JP | 2012172912 | A | 9/2012 |
| WO | 2014030149 | A2 | 2/2014 |
| WO | 2014/147524 | A1 | 9/2014 |
| WO | 2014147510 | A1 | 9/2014 |
| WO | 2014205547 | A1 | 12/2014 |

OTHER PUBLICATIONS

International Preliminary Report on Patentability dated Apr. 4, 2017, issued in corresponding International Application No. PCT/EP2016/050076, filed Jan. 5, 2016, 27 pages.

Written Opinion of the International Searching Authority dated Apr. 22, 2016, issued in corresponding International Application No. PCT/EP2016/050076, filed Jan. 5, 2016, 6 pages.

Office Action dated Dec. 10, 2019, issued in corresponding Japanese Application No. 2017-535655, filed Jun. 30, 2017, 2 pages.

METHOD FOR CONTROLLING THE LIGHT DISTRIBUTION OF A LUMINAIRE

CROSS-REFERENCES TO RELATED APPLICATIONS

This application is a continuation of U.S. patent application Ser. No. 16/505,376, filed Jul. 8, 2019, now U.S. Pat. No. 10,733,882, which is a continuation of U.S. patent application Ser. No. 15/540,971, filed Jun. 29, 2017, now U.S. Pat. No. 10,347,123, which is the National Stage of International Application No. PCT/EP2016/050076, filed Jan. 5, 2016, which claims the benefit of European Application No. 15150120.2, filed Jan. 5, 2015, all the disclosures of which are incorporated by reference herein.

FIELD OF DISCLOSURE

Embodiments of the present disclosure relate to a method for controlling the light distribution of a traffic route luminaire in a network of luminaires, which is preferably also organized as a mesh network, in which the traffic route luminaire includes a luminaire head having a settable light module and a controller and in which the light distribution of the traffic luminaire is variable. Furthermore, embodiments of the present disclosure relate to a traffic route luminaire in which the method is implemented and to a network of luminaires comprising a plurality of traffic route luminaires.

BACKGROUND

The term "traffic route luminaires" are understood to mean luminaires which are installed on roads, cycle paths, pedestrian paths or in pedestrian zones, for example. They can be luminaires which mounted to be at a distance from the ground via a mast anchored in the ground or which are centrally mounted over roadways, for example, between fronts of houses.

Suppliers of traffic route luminaires offer a multiplicity of light modules to the operators of luminaire networks, these light modules realizing a desired light distribution of the associated traffic route luminaire. The light distribution is obtained via an orientation of the lenses of light-emitting diodes (LEDs) or by reflectors, for example. Accordingly, the light module with its illuminants, reflectors and, if appropriate, parts of the housing, can achieve a desired light distribution via the direction of the emission of individual LEDs.

When replacing a defective illuminant, a defective light module or a defective luminaire, it is necessary to provide a luminaire having an identical light distribution using specific settings of the reflectors, lenses, etc. This necessitates extensive stock keeping.

Different methods for controlling the light distribution of a traffic route luminaire have already been disclosed. For example, US-A-2013/0147389 discloses an auto-configuring runway luminaire network in which each luminaire is controlled by a central controller. The central controller uses the installation location information transmitted by the luminaires to distinguish and organize them into different function groups. Moreover, the intensity, the wavelength (i.e. the color), the flash pattern, and the on/off status of each luminaire can be controlled by the central controller.

WO-A-2014/147510 discloses a central management system for an outdoor lighting network (OLN) system. Sensors in the lighting units send information to the central management system which then reports events (e.g. road hazards, light unit failures, etc.) to a user. Furthermore, the system may be adapted for energy saving processes, public safety alarms, etc.

US-A-2013/0285556 discloses a policy-based light management (PBLM) system which allows an operator to specify the behavior of an outdoor lighting network (OLN). The installer of the OLN has to provide the specific luminaire information and the specific policies for the PBLM system. After installation, the operator can change the OLN policy and a central control apparatus reviews the proposed changes in accordance with the current OLN policy. In particular, a newly installed luminaire controller can provide a new OLN policy to the central control apparatus.

WO-A-2014/205547 is directed to an infrastructure interface module (TIM) for a lighting infrastructure. Each luminaire may have an integral GPS receiver that permits the establishment of a mapping of the luminaires. This, in turn, allows the IIM to adjust each luminaire based upon the local environment (e.g. area function as defined by municipality, special events, sensors associated with the IIM, etc.) after installation. Furthermore, each luminaire may automatically be configured at installation.

However, there is no disclosure of adjusting being able to adjust individual luminaires, and, in particular, being able to set the light module on the basis of an allocated light distribution determined from luminaire-specific data, in order to be able to reuse luminaires in different locations where different light distribution classes are needed in any of the documents described above.

SUMMARY

According to the present disclosure, communication between a traffic route luminaire and at least one server in the network of luminaires is provided in order to communicate luminaire data from the traffic route luminaire to the at least one server, the luminaire data being luminaire-specific and including the installation location of the luminaire. Afterwards, a light distribution is automatically allocated to the traffic route luminaire and a setting of the light module on the basis of the allocated data is automatically affected. Moreover, a light distribution class of the traffic route luminaire is determined on the basis of a traffic route topology by the at least one server as described below. The light module is settable on the basis of actuating means also described below.

An advantage of the method according to the present disclosure is that the operator of the traffic route luminaire has the possibility of determining how the light distribution of a luminaire is intended to appear using the traffic route luminaire information on the server side either manually or in an automated manner. Subsequently, the luminaire, after its installation brought about by the controller, is provided with data for its light distribution in an automated manner. As such, on the luminaire side, the luminaire controller then automatically ensures a setting of the light module on the basis of the data. The assignment of data for a light distribution (i.e. light distribution data) presupposes that luminaire-specific identification and geolocation information related, in particular, to the installation location of the traffic route luminaire have been communicated to the server or network of servers.

As used herein, the term "a luminaire" is intended to refer to a traffic route luminaire, particularly but not exclusively, comprising a luminaire head arranged on a luminaire mast. The luminaire head can also be positioned without a luminaire mast on a house wall or centrally between house walls. The luminaire head contains a light module which is settable in such a way that the light distribution of the luminaire is variable, in particular by way of actuating means, and, if appropriate, also via switching on and off of individual illuminant groups having a different emission characteristic from those already switched on.

The light distribution of the luminaire arises on the basis of the emission characteristic of the light module, i.e. on the basis of the light emerging from the luminaire or the light module at specific angles and specific light intensities. The light module includes the illuminants, the lenses and, if appropriate, reflectors assigned thereto provided that the reflectors are settable. The light module can also be formed at least in part by the housing of the luminaire head.

The controller is a control module which is arranged within the housing of the luminaire head or on the luminaire housing. The controller forwards control signals for driving the light of the luminaire and is, in particular, responsible for the communication with the at least one server of a luminaire group. There are also controllers which can additionally process sensor information. These can also be used for changing the emission characteristic in one embodiment of the present disclosure. The communication within the network with the server and possible with further luminaires can also be affected via the controller.

Each server can be reached either via long-distance communication or alternatively via internal network paths. If appropriate, the server is kept available via the Internet. For example, a telemanagement system responsible for the control of a network of traffic route luminaires operated by the operator of the network running on a network server.

The network server can also be represented by a plurality of servers. For example, an initial set of luminaire data of a traffic route luminaire is transmitted from the traffic route luminaire to a first server and afterwards the information relating to the light distribution of the luminaire is transmitted from a second server to the traffic route luminaire. In this particular example, the first and second servers are connected to one another, either directly or via a server network.

The terms "network server" and "network servers" are intended to refer to servers which are used in a luminaire network. It will readily be appreciated that if the luminaire network comprises one or more sub-networks, one or more network server(s) may be assigned to each of the sub-networks.

In another example, a registration server may initially be involved which merely regulates the assignment of a traffic route luminaire to a corresponding project server wherein the project server is subsequently responsible for the communication with the controller of the traffic route luminaire. As such, the project server provides the traffic route luminaire with the necessary information for its operation, in particular the light distribution and the required setting of the light module.

The term "registration server" is intended to refer to a server with which each luminaire registers on installation and/or on commissioning. The registration server may allocate each luminaire to a network or sub-network which is controlled by one or more network servers. Although having a particular function, the registration server is also a network server.

The term "project server" is intended to refer to a server which is used for the overall management of one or more luminaire networks and/or sub-networks. Although having a particular function, the project server is also a network server.

Instead of geolocalization data, it is also possible to use data on the basis of GPS or other navigation system data such as Galileo, Glonass or Baidou, for example.

Preferably, a light distribution class is assigned to the luminaire by one of the servers. The light distribution class arises from the position of the luminaire and, consequently, from the installation location data communicated to the server. For example, different expedient light distributions which can be realized on roads which may correspond to a specific emission characteristic of a traffic route luminaire which is defined beforehand in order to be able to perform a simple and fast or quick assignment of the traffic route luminaires into individual classes. This assignment results in a certain standardization and simpler consideration depending on the traffic route to be illuminated.

Preferably, the light distribution class of a luminaire is determined on the basis of a traffic route topology. For example, the traffic route topology arises on the basis of a road situation, the type of road (e.g. main road, minor road, junction, roundabout, car park, one-way street), an assignment of the roads or road regions to required light distributions and/or the arrangement, in particular the spacing, of light points along the road. Legal stipulations can also be taken into account. In addition to roads available for motor vehicles, traffic routes for other road users can also be taken into account.

The term "road topology" is to be understood as meaning the traffic route framework which also underlies, for example, navigation systems and which provides items of information about the roadways such as the width of the roads or paths and possibly also time-dependent or non-time-dependent traffic density. Depending on the traffic route situation on a traffic route or on a region of the road, a light distribution is defined for this region. This light distribution is intended to be achieved by one or a plurality of luminaires positioned at or on the traffic route. As such, the illumination necessary for the traffic route is ensured while making the traffic route suitable for traffic.

Moreover, the light distribution to be realized by the luminaires is also determined by the spatial arrangement of light points with respect to one another and along the road topology. For example, a traffic route luminaire only has to illuminate a part of the roadway nearest to that traffic route luminaire if a traffic route luminaire is also present on the opposite side of the road, while the same traffic route luminaire would have to illuminate the entire width of the roadway when no traffic route luminaire is present on the opposite side of the road.

The associated database containing the traffic route topology can be present locally or can be web-based. Therefore, with the aid of the traffic route topology and the light point arising with a traffic route luminaire, a traffic route is identified or is assigned to at least one traffic route luminaire. As such, the corresponding required light distribution information for the traffic route luminaire then arises from the light distribution associated with the light distribution class.

Hereinafter, only roads and road luminaires are mentioned for simplification, although arbitrary traffic routes or areas can also be involved here.

Advantageously, the light module has a plurality of light-emitting diodes (LEDs), which are classified into different groups for realizing the desired light distributions. The maximum number of groups arises from the maximum number of LEDs but only if each LED is classified into a dedicated group. Typically, however, a plurality of LEDs are combined to form a group in order to obtain, as a result of the setting thereof, a significant change in the emission characteristic if the entire group is moved, the lenses thereof are moved, associated reflectors are moved and/or the lighting current of one or more groups is increased, for example.

Alternatively or additionally, the light module can be embodied on the basis of organic LEDs (OLEDs) which are classified into different groups for realizing the desired light distribution. In this case, either a luminous area formed by OLEDs can be divided into a plurality of separately driveable groups by classification into different regions. Likewise, it is possible to divide a plurality of OLED-based luminous areas in a light module into correspondingly different groups.

According to the disclosure, a controller is provided with a data set having an assignment of different light distributions for the settings of the different groups. The necessary parameter sets that determine the driving of the actuating means of the respective groups are then stored locally in tabular form, for example. Thus, the parameters to be stored depend on the respective actuating means of the groups of LEDs or OLEDs.

Advantageously, the controller instigates the setting of the groups while the individual groups can be driven via one of a bus system and separate control outputs of the controller.

The light distribution data can be communicated during or with a temporal separation after the initial start-up of the luminaire. In this regard, it is possible to provide the traffic route luminaire with a parameter set for the light distribution directly upon the initial installation and initial start-up of the controller, for example.

Moreover, the controller, when logging on for the first time at the at least one server (e.g. the registration sever) communicates the location data and other reference data specifying the traffic route luminaire to the at least one sever. As such, the traffic route luminaire becomes known in the system (e.g. the telemanagement system) including the at least one server. Afterwards, the traffic route luminaire is assigned a light distribution which the luminaire is intended to realize and a light distribution class. During a communication between at least one server (e.g. the project server) and the controller via which the integration of the traffic route luminaire into an associated mesh network is initiated, and which is thus necessary for the initial start-up, the information about the light distribution class can also be communicated. Afterwards, the traffic route luminaire orients the light module or the groups thereof in a manner indicated by the controller.

Alternatively or additionally, in order to realize an altered illumination situation and thus a new assignment to a light distribution class with a temporal separation after an initial start-up of the luminaire the at least one server (e.g. the project server) can communicate a corresponding signal to the traffic route luminaire such that the latter changes its light distribution and its emission characteristic. This can also be carried out dynamically depending on specific traffic information, road user densities or during the course of a day for example.

In particular, depending on a failure of an adjacent traffic route luminaire, it is possible to communicate, either in an automated manner or manually, light distribution data including a widened emission compared with a previous emission to the traffic route luminaire. As such, the failure of a traffic route luminaire can be at least partly compensated for by adjacent traffic route luminaires by virtue of the fact that adjacent luminaires change their light distribution to widen their emission. This significantly increases the operational safety of the illuminated traffic route. Such an allocation can also be effected manually in response to a fault signal, such that the operator can decide, on an individual case-by-case basis, whether adjacent luminaires need to acquire a new emission characteristic or whether which of the adjacent luminaires is to acquire a new emission characteristic. It will be appreciated that at least one adjacent luminaire acquires a new emission characteristic in accordance with such a fault signal.

It is also advantageous if the assignment of the light distribution for a traffic route luminaire that was performed in an automated manner on the server side can be manually overwritten, such that a luminaire which has acquired no assignment or which has acquired an incorrect assignment can be allocated with or receive a correct light distribution or light distribution class. For this purpose, the associated system (i.e. the telemanagement system) has correspondingly suitable operating means corresponding to graphic user interfaces (GUIs) on the server side, for example.

In accordance with a further embodiment of the disclosure, the orientation and/or the form of LED printed circuit boards (PCBs) can be varied for setting the light distribution. Alternatively or additionally, the orientation and/or the form of lenses assigned to the LEDs can be varied for setting the light distribution. For example, electroactive polymers or materials that react to the application of an electrical voltage in some way can be used for this purpose.

Furthermore, alternatively or additionally, the orientation and/or the form of reflectors assigned to the LEDs can be varied for setting the light distribution. Associated actuating means for the above-described orientation and form of the LED PCB and/or the lenses and/or the assigned reflectors can be electrical servomotors having an expansion drive, ultrasonic motors similar to the focal length modulation in the case of camera lenses or the plastics referred to above, for example.

A traffic route luminaire according to the present disclosure for achieving the object stated in the introduction comprises corresponding actuating means alongside the required communication and electronic data processing (EDP) means.

The above-described object is also achieved by means of a traffic route luminaire which is set up using the method referred to above or described below, wherein the traffic route luminaire comprises a plurality of LEDs or at least one OLEDs and wherein the emission angle of the light originating from the LED or OLED is variable in a manner instigated by a controller of the traffic route luminaire and the associated actuating means.

Similarly, the present disclosure applies to a network of luminaires which comprises a plurality of traffic route luminaires described above, in which at least one server and communication means for the communication between the traffic route luminaires themselves and/or with the at least one server are included. Software having the associated databases and programs for the operation of the network is present on the at least one server itself.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

Figure 1:
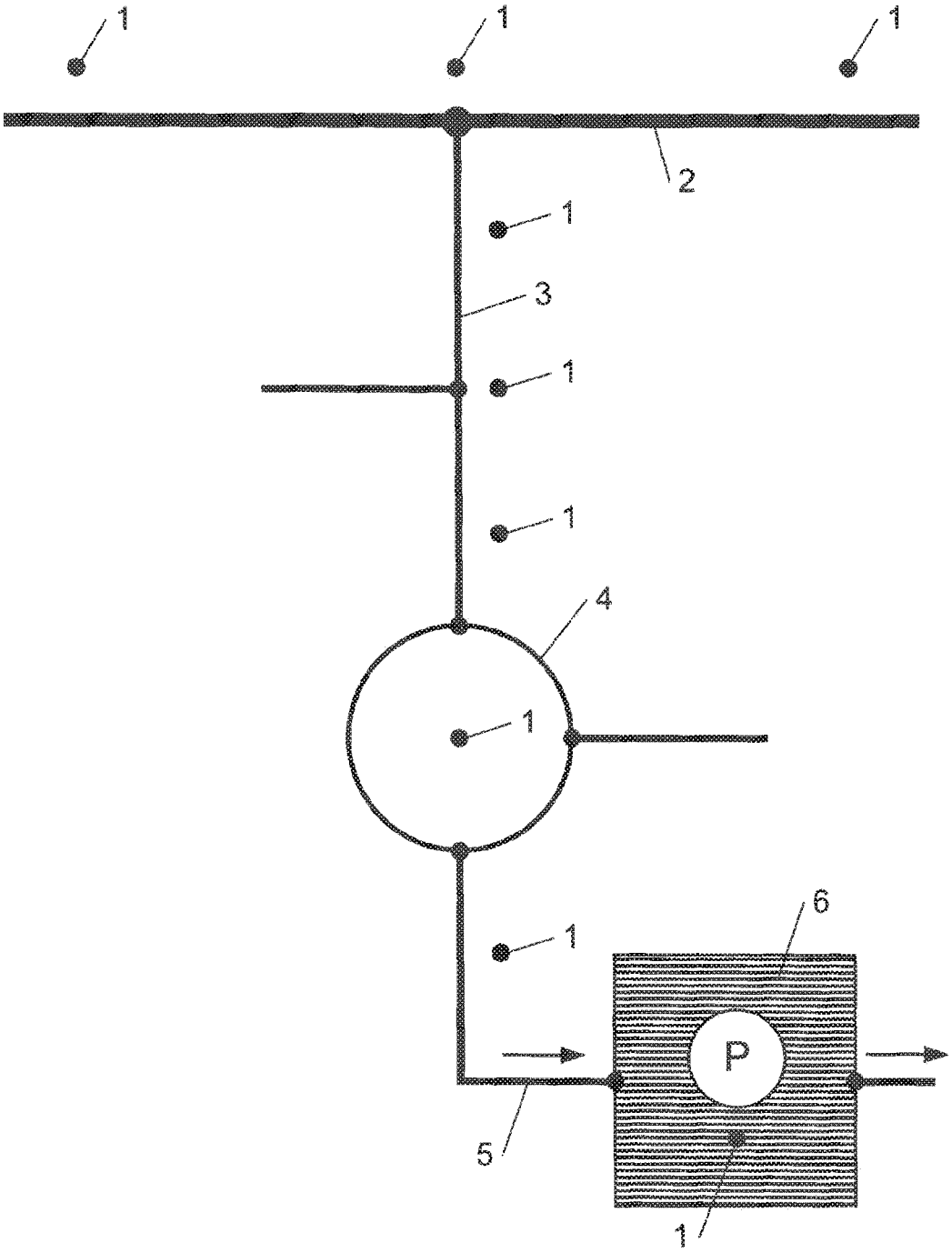
FIG. 1 illustrates a road topology with individual luminaires.

Individual technical features of the represented embodiments described below can also be combined in combination with representative embodiments described previously and also the features of the embodiments described below and with possible further embodiments to form subject-matter according to the disclosure. Insofar as is expedient, elements having a functionally identical action are provided with identical reference numerals.

In order to carry out the method according to the present disclosure in accordance with the first exemplary embodiment, first starting with traffic route luminaire information relating to the installation location of the luminaires, a mapping of the road topology with assigned light points, each corresponding to a traffic route luminaire, is formed. A view of such a topology with associated luminaires 1 is illustrated in FIG. 1. From the spatial coordinates communicated by the luminaires, which coordinates thus constitute luminaire data relating to the installation location of the luminaire, luminaires 1 are integrated into a road topology. The road topology can be obtained from Internet databases, from a dedicated database or is present on the server side, for example. The road topology shows a plurality of roads and characterizes them clearly. FIG. 1 shows a road 2 being a main traffic road, a road 3 being a link road, a ring of roads corresponding to a roundabout 4 and a road 5 being an access to a car park 6. Further information about the roads can be gathered from the road topology. For example, to what extent a multi-lane road is involved, how wide the road is and whether one-way streets or traffic-calmed zones are involved.

The spatial assignment of the light points or of the luminaires 1 to the respective roads is effected by means of a distance function, for example. As a result of the knowledge of light distribution classes assigned to the respective roads the light distribution or light distribution class required for the respective luminaire arises taking account of the distance between the luminaires.

FIGS. 2*a* to 2*e* illustrate some examples of respective light distribution classes which can correspondingly be assigned to traffic route luminaires 1.

Figure 2A:
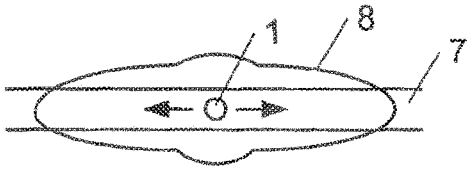
FIGS. 2*a* to 2*e* illustrate possible light distribution classes.
Figure 2B:
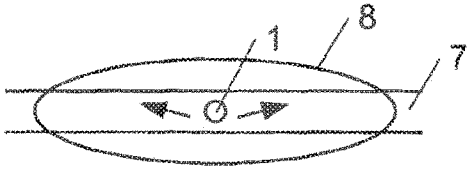
Figure 2C:
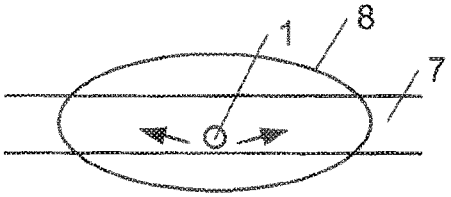
Figure 2D:
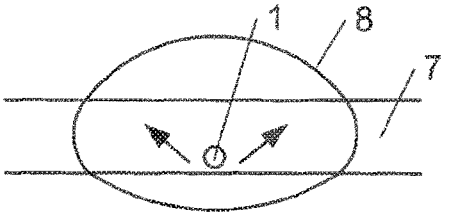
Figure 2E:
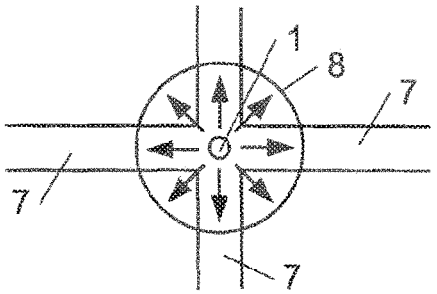

For example, the luminaire 1 arranged on the narrow road 5 (FIG. 1) designed as a one-way street and functioning as an access road to a car park is to be operated with a light distribution in accordance with FIG. 2*b* (light distribution class II) where only a narrow road needs to be illuminated. For a luminaire 1 arranged centrally in the roundabout 4 or at a cross roads where the intersecting roads are the same size and need to be uniformly lit, the luminaire is to be classified with a light distribution in accordance with FIG. 2*e* (light distribution class V). The luminaires 1 arranged on the main road 2 are characterized by means of the light distribution in accordance with FIG. 2*d* (light distribution class IV). Similarly, FIGS. 2*a* and 2*c* respectively illustrate luminaires 1 which are classified in accordance with light distribution classes I and III.

In addition to the classification in accordance with FIGS. 2*a* to 2*e*, further light distribution classes representing further-reaching light distributions can be defined depending on the situation or on empirical values. The respective light distributions arise on the basis of the emission characteristics of a luminaire 1 arranged relative to a schematically illustrated road 7. An envelope 8 of the light distribution from the luminaire 1 appears as a transition from an area illuminated with a specific brightness towards the surroundings. The envelope 8 arises substantially as a result of the emission angles of the light emerging from the light module of a luminaire 1.

Figure 3:
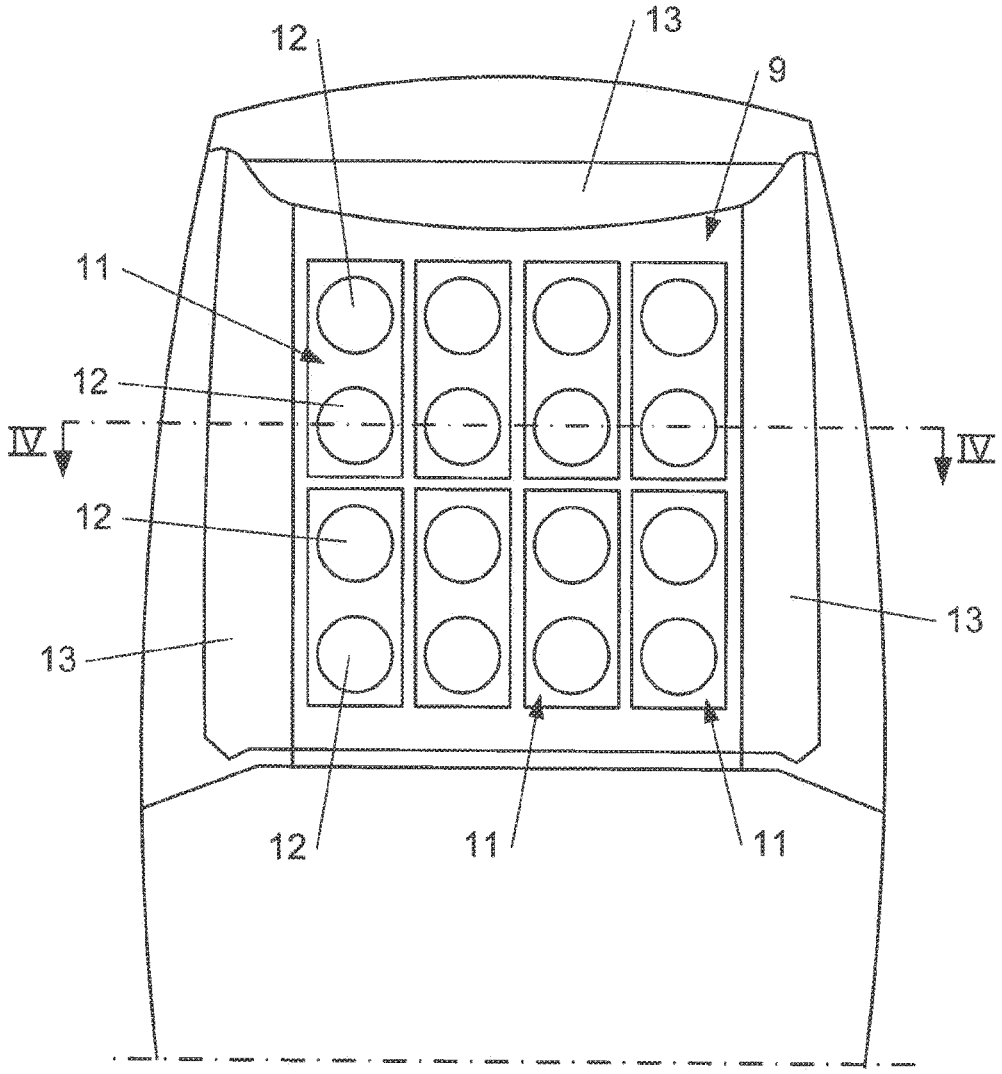
FIG. 3 illustrates a traffic route luminaire in a partial bottom view.

In accordance with the exemplary embodiment in FIG. 3, a light module 9 in the present exemplary embodiment has a total of eight groups 11 of, in each case, two LEDs 12. The LED groups 11, which can also constitute in each case a dedicated printed circuit board, are laterally delimited by reflectors 13 by means of which the light emergence can furthermore be influenced. It will be appreciated that a light module may comprise a different number of groups, each group comprising a different number of LEDs.

Figure 4A:
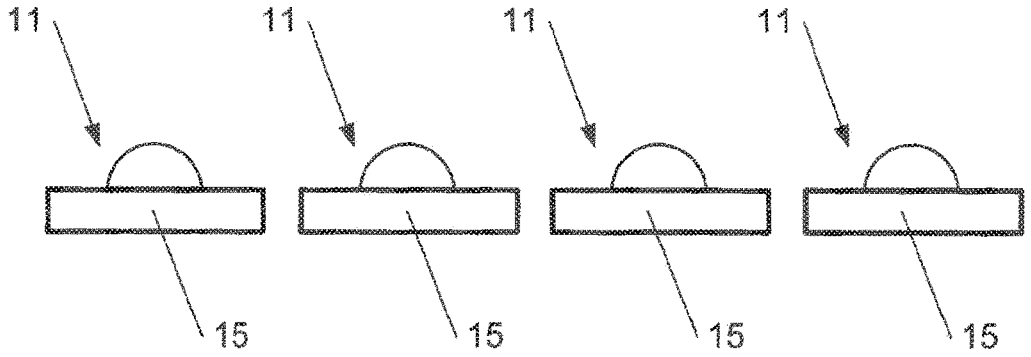
FIGS. 4*a* and 4*b* illustrate parts of the traffic route luminaire according to FIG. 3 in different operating modes.
Figure 4B:
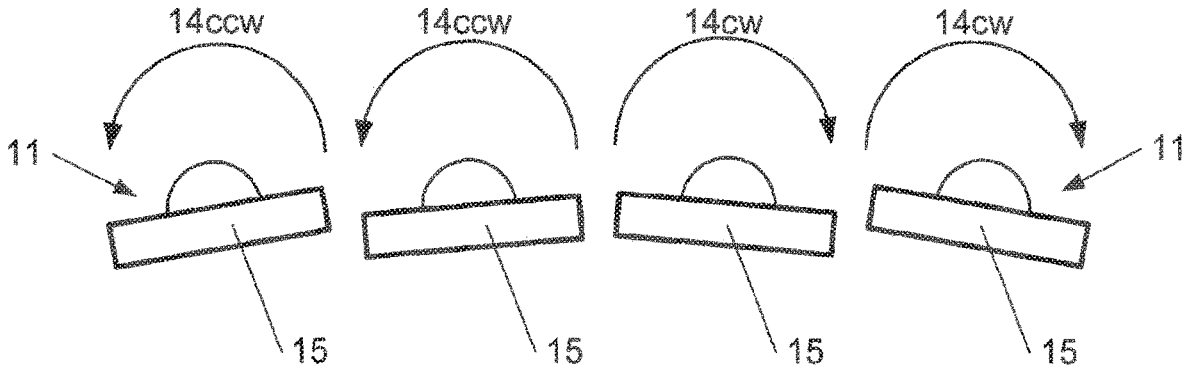

After the allocation of a light distribution class by the server and by corresponding instructions in the controller the groups 11, as shown in the vertical section IV-IV indicated in FIG. 3, can pivot from their position shown in FIG. 4*a* to the predefined position in accordance with FIG. 4*b*. Clockwise arrows 14CW and counter-clockwise arrows 14CCW show the direction of movement of the individual LED groups 11 mounted on their dedicated printed circuit boards 15, which pivot about a pivoting axis (not illustrated) in a motor-driven fashion by actuating means.

Figure 5:
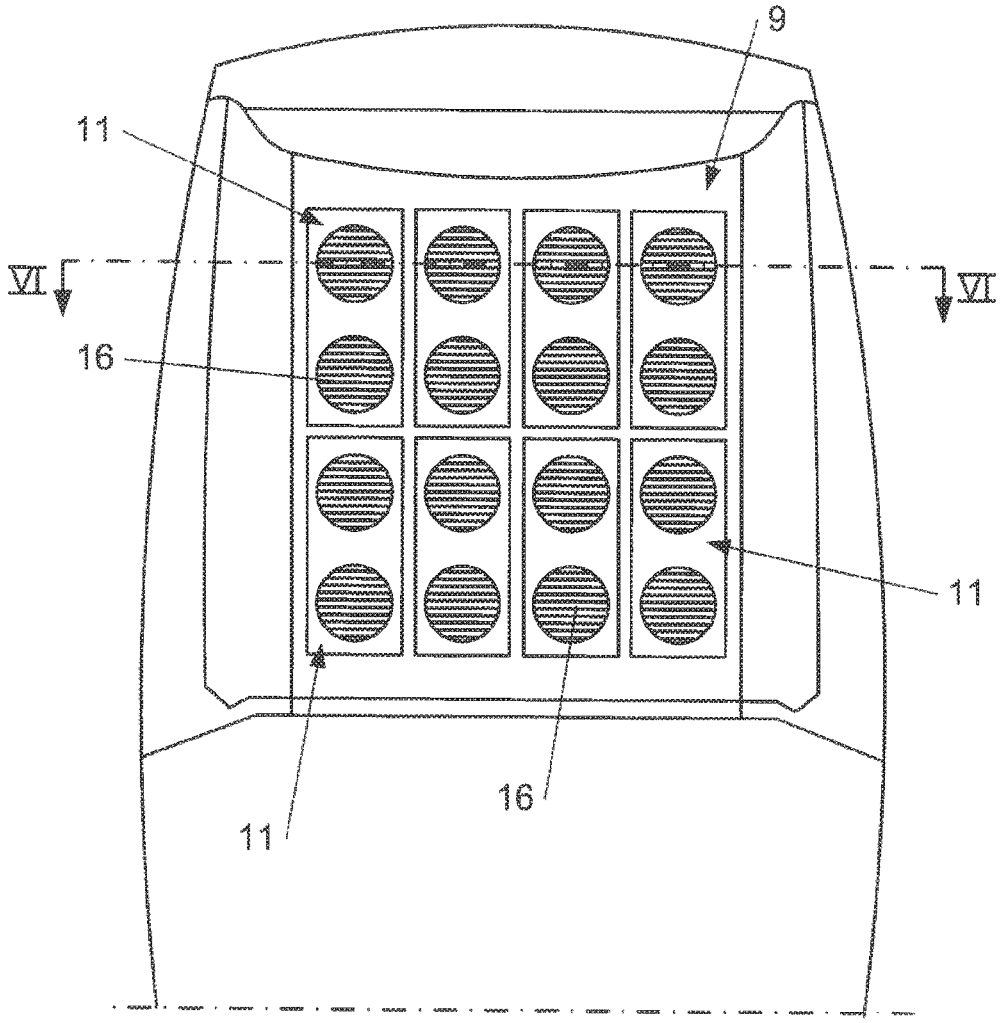
FIG. 5 illustrates a further exemplary embodiment of a traffic route luminaire according to the disclosure in a partial bottom view.

In accordance with the exemplary embodiment in FIG. 5, a light module 9 is realized in which the illuminants or LEDs of the groups 11 are settable (i.e. the emission angles are variable) not just by a variation of the orientation of the entire groups 11 including the underlying printed circuit board 15 as illustrated in FIG. 4, but also via lenses 16 that are adaptable in terms of their form.

Figure 6A:
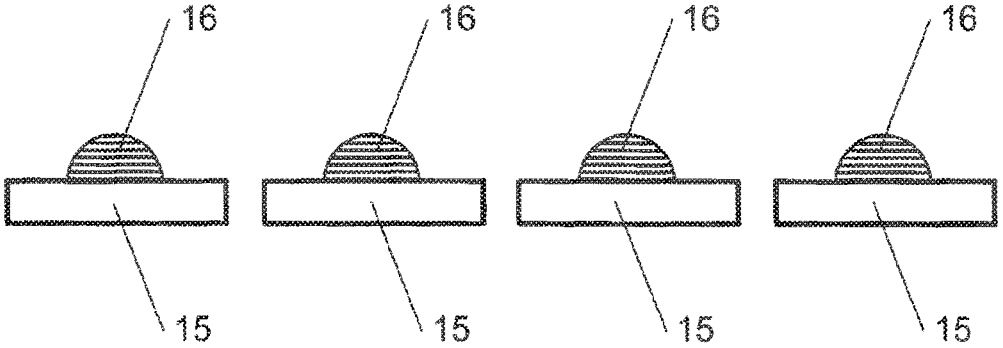
FIGS. 6*a* and 6*b* respectively illustrate parts of the traffic route luminaire according to FIG. 5 in different operating modes.
Figure 6B:
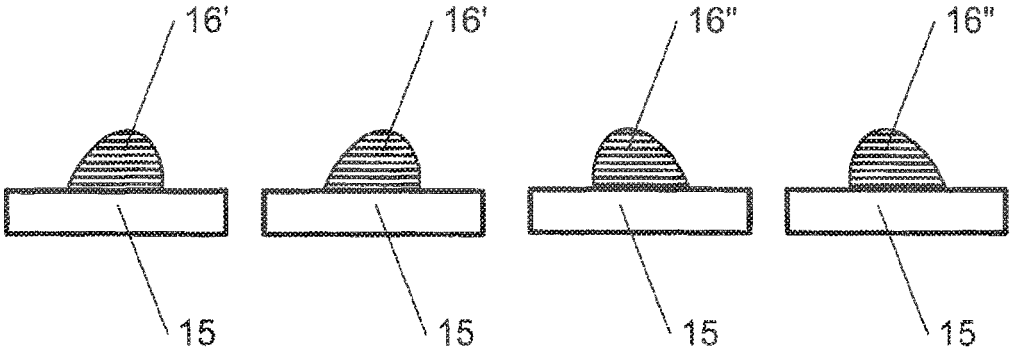

In this regard, the lenses 16 as shown in the vertical section VI-VI indicated in FIG. 5 change from a basic position having, for example, a semi-circular form in accordance with FIG. 6*a* towards a lens form shaped depending on the desired emission characteristic, for example as an obliquely truncated elliptical paraboloid 16' in accordance with FIG. 6*b*. In particular, electroactive polymers having a sufficient thermal stability can be used in this case.

Alternatively or additionally, further changes in the emission characteristic can be brought about by means of an adjustment of the orientation of the printed circuit boards 15 and/or the reflectors 13.

Figure 7:
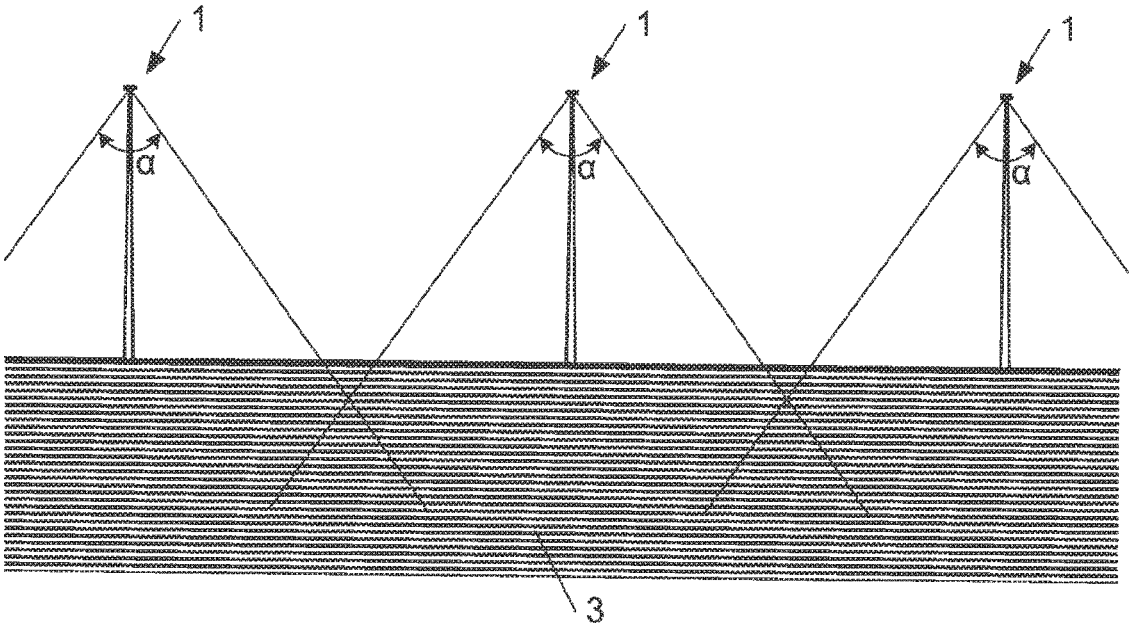
FIG. 7 illustrates an illumination situation on a road.
Figure 8:
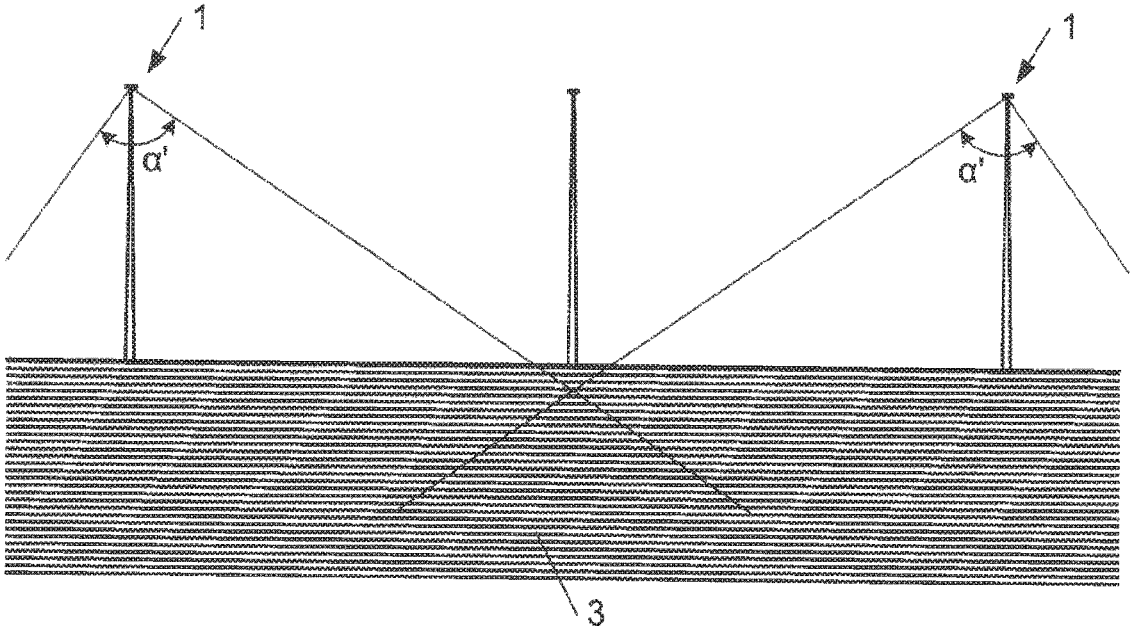
FIG. 8 illustrates an illumination situation on the road with a widened emission compared to the illumination situation in FIG. 7.

For sufficient illumination, depending on the road topology and the light distribution class, a setting in accordance with FIG. 7 arises in which an emission angle $\alpha$ of a luminaire 1—viewed in the plane of FIG. 7—embodied as a traffic route luminaire is about 70°, for example. A road 3 is sufficiently illuminated thereby. For the case where the middle luminaire 1 illustrated in FIG. 7 then fails and a corresponding signal from a server of an assigned telemanagement system or of the network of luminaires 1 requires knowledge of this, the adjacent luminaires 1 can be instructed in an automated manner to adapt their light distribution in order to ensure sufficient illumination for the road despite the failure. In this case, the aperture angles in the emission are altered towards the middle luminaire in such a way that both adjacent luminaires 1 have an emission angle α' of somewhat more than 90° as viewed in the plane of FIG. 7, for example. Additionally, the lighting current towards the middle luminaire can be increased.

Although the emission angle α of each of the luminaires 1 in FIG. 7 are shown to be the same, it will readily be appreciated that each emission angle may be different for each luminaire 1.

Moreover, it will readily be understood that the emission angle is not limited to the plane of FIG. 7 but is, in effect, defined by an angle of a cone and can be regular or irregular in accordance with the light distribution class as described above with reference to FIGS. 2*a* to 2*e*.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 5% of the stated value. For the purposes of the present disclosure, the phrase "at least one of A, B, and C," for example, means (A), (B), (C), (A and B), (A and C), (B and C), or (A, B, and C), including all further possible permutations when greater than three elements are listed.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A method for controlling the light distribution of a luminaire including a luminaire head having a settable light module, the settable light module comprising a group of light-emitting diodes mounted on a circuit board, and lenses associated with said light-emitting diode elements;

the light distribution of the luminaire being variable;

the method comprising setting the light module on the basis of a light distribution, by at least one of the following actions:

moving said group of light-emitting diodes;

moving said lenses;

varying the form of said lenses;

varying the orientation of said lenses;

varying the form of said circuit board;

varying the orientation of said circuit board; and increasing lighting current of said group.

2. The method according to claim 1, wherein the light-emitting diodes of the settable light module are classified into different groups for realizing the desired light distribution.

3. The method according to claim 2, wherein the luminaire head has a controller and further comprising:

providing the controller with a data set for the setting of the different groups, said data set including an assignment of different light distributions.

4. The method according to claim 1, further comprising:

communicating data relating to the light distribution from a server during initial start-up of the luminaire, or with a temporal separation after initial start-up of the luminaire.

5. The method according to claim 4, further comprising:

communicating data relating to the light distribution manually or in an automated manner.

6. The method according to claim 4, further comprising:

communicating data relating to the light distribution provides a widened emission compared to a previous emission in accordance with a failure of an adjacent luminaire.

7. The method according to claim 1, wherein the setting of the light module is done on the basis of a light distribution class, in order to achieve a light distribution in accordance with said light distribution class.

8. A luminaire comprising a luminaire head having a settable light module comprising a group of light-emitting diode elements mounted on a circuit board, and lenses associated with said light-emitting diode elements, light originating from the settable light module having a variable light distribution which is controlled by at least one of:

moving said group of light-emitting diodes;

moving said lenses;

varying the form of said lenses;

varying the orientation of said lenses;

varying the form of said circuit board;

varying the orientation of said circuit board; and increasing lighting current of said group.

9. The luminaire according to claim 8, wherein the settable light module further comprises reflectors associated with said light-emitting diode elements.

10. A network of luminaires comprising a plurality of luminaires according to claim 8, at least one server and means for communication between the luminaires and the at least one server.

11. The network of luminaires according to claim 10, wherein the means for communication further provides communication between the luminaires themselves.

12. The method according to claim 1, wherein the luminaire comprises a controller able to communicate with a server and wherein the setting of the light module on the basis of a light distribution is triggered by information sent from the server to the controller.

13. The method according to claim 12, wherein the controller sends to the server location information indicating the location of the luminaire and the server determines the light distribution based on said location information before the server sends information to the controller triggering the setting of the light module.

14. The method according to claim 2, wherein the different groups have different emission characteristics.

15. The method according to claim 2, wherein the luminaire head has a controller and wherein the luminaire orients the light module or the groups in a manner indicated by the controller.

16. The method according to claim 2, wherein each group is mounted on a circuit board.

17. The luminaire according to claim 9, wherein the reflectors are arranged to be moved and/or to be varied in form and/or orientation in accordance with the light distribution.

18. A method for controlling the light distribution of a luminaire including a luminaire head having a settable light module, the settable light module comprising a group of light-emitting diodes, and reflectors associated with said light-emitting diode elements;

the light distribution of the luminaire being variable;

the method comprising setting the light module on the basis of a light distribution, by at least one of the following actions:

varying the form of said reflectors;

varying the orientation of said reflectors;

moving said reflectors;

moving said group of light-emitting diodes; and increasing lighting current.

19. A luminaire comprising a luminaire head having a settable light module comprising a group of light-emitting diode elements, and reflectors associated with said light-emitting diode elements, light originating from the settable light module having a variable light distribution which is controlled by at least one of:

varying the form of said reflectors;

varying the orientation of said reflectors;

moving said reflectors;

moving said group of light-emitting diodes; and increasing lighting current.

20. The method according to claim 18, wherein the luminaire comprises a controller able to communicate with a server and wherein the setting of the light module on the basis of a light distribution is triggered by information sent from the server to the controller.

21. The method according to claim 20, wherein the controller sends to the server location information indicating the location of the luminaire and the server determines the light distribution based on said location information before the server sends information to the controller triggering the setting of the light module.

22. The method according to claim 18, wherein the settable light module comprises lenses associated with said light-emitting diode elements.

23. The method according to claim 1, wherein the luminaire comprises actuating means configured for setting an emission angle of a light cone associated with the light originating from the plurality of light-emitting diodes on the basis of the light distribution by at least one of the following actions:

moving said group of light-emitting diodes;

moving said lenses;

varying the form of said lenses;

varying the orientation of said lenses;

varying the form of said circuit board; and varying the orientation of said circuit board.

24. The luminaire according to claim 8, comprising actuating means configured for setting an emission angle of a light cone associated with the light originating from the plurality of light-emitting diodes on the basis of the light distribution by at least one of the following actions:

moving said group of light-emitting diodes;

moving said lenses;

varying the form of said lenses;

varying the orientation of said lenses;

varying the form of said circuit board; and varying the orientation of said circuit board.

25. The method according to claim 18, wherein the luminaire comprises actuating means configured for setting an emission angle of a light cone associated with the light originating from the plurality of light-emitting diodes on the basis of the light distribution by at least one of the following actions:

varying the form of said reflectors;

varying the orientation of said reflectors;

moving said reflectors; and moving said group of light-emitting diodes.

26. The luminaire according to claim 19, comprising actuating means configured for setting an emission angle of a light cone associated with the light originating from the plurality of light-emitting diodes on the basis of the light distribution by at least one of the following actions:

varying the form of said reflectors;

varying the orientation of said reflectors;

moving said reflectors; and moving said group of light-emitting diodes.

* * * * *